US008474921B2

(12) United States Patent
Newkirk et al.

(10) Patent No.: US 8,474,921 B2
(45) Date of Patent: Jul. 2, 2013

(54) WALL-MOUNTED PATIENT EGRESS AND PATIENT ASSIST BAR

(75) Inventors: David C. Newkirk, Lawrenceburg, IN (US); Dennis J. Gallant, Harrison, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 308 days.

(21) Appl. No.: 12/893,828

(22) Filed: Sep. 29, 2010

(65) Prior Publication Data

US 2011/0084578 A1 Apr. 14, 2011

Related U.S. Application Data

(60) Provisional application No. 61/248,166, filed on Oct. 2, 2009.

(51) Int. Cl.
*B01L 99/00* (2010.01)

(52) U.S. Cl.
USPC ..... 312/209; 312/310; 5/662; 52/36.4; 16/438

(58) Field of Classification Search
USPC ..... 312/209, 310, 311; 4/604, 576.1; 5/662, 5/428, 430; 16/436, 438; 52/29, 32, 36.4, 52/174, 184; 108/48, 50.16
See application file for complete search history.

(56) References Cited

U.S. PATENT DOCUMENTS

| | | | | |
|---|---|---|---|---|
| 3,085,258 | A | 4/1963 | Wolferts | |
| 3,568,220 | A * | 3/1971 | Dees | 4/576.1 |
| 4,003,536 | A * | 1/1977 | Sekerich | 248/585 |
| 4,908,906 | A * | 3/1990 | Hanna | 16/445 |
| 4,932,090 | A * | 6/1990 | Johansson | 5/662 |
| 5,586,352 | A * | 12/1996 | O'Brien et al. | 5/662 |
| 6,135,621 | A * | 10/2000 | Bach et al. | 362/399 |
| 7,040,057 | B2 * | 5/2006 | Gallant et al. | 52/36.1 |
| 7,100,316 | B2 * | 9/2006 | Obileye | 38/139 |
| 7,319,386 | B2 * | 1/2008 | Collins et al. | 340/539.12 |
| 7,395,620 | B1 * | 7/2008 | McNeely et al. | 38/137 |
| 7,395,764 | B2 * | 7/2008 | Debrunner | 104/89 |
| 7,823,229 | B2 * | 11/2010 | O'Brien et al. | 4/576.1 |
| 8,210,705 | B2 * | 7/2012 | Pesson et al. | 362/146 |
| 2004/0133979 | A1 * | 7/2004 | Newkirk et al. | 5/600 |
| 2006/0053547 | A1 * | 3/2006 | Farrow et al. | 4/576.1 |
| 2006/0087097 | A1 | 4/2006 | Kramer et al. | |

(Continued)

FOREIGN PATENT DOCUMENTS

| | | |
|---|---|---|
| DE | 295 16 070 U1 | 1/1997 |
| EP | 1 969 983 A2 | 9/2008 |

(Continued)

OTHER PUBLICATIONS

European Search Report for EP 10 18 4730, dated Dec. 13, 2010, (7 pages).

*Primary Examiner* — Hanh V Tran

(74) *Attorney, Agent, or Firm* — Barnes & Thornburg LLP

(57) ABSTRACT

A support apparatus includes a patient assist bar that is coupled to a wall or to some other structure in a room of a healthcare facility, such as a headwall that is configured to be coupled to the room wall. The patient assist bar is pivotable a first axis that is substantially vertical and parallel to the headwall and a second axis that is substantially horizontal. The patient assist bar provides the patient with a stable support and guidance in moving about the room.

13 Claims, 7 Drawing Sheets

U.S. PATENT DOCUMENTS

| | | | | |
|---|---|---|---|---|
| 2006/0207025 | A1* | 9/2006 | Newkirk et al. | 5/600 |
| 2007/0180624 | A1* | 8/2007 | Newkirk et al. | 5/663 |
| 2008/0289296 | A1* | 11/2008 | Weber | 52/835 |

FOREIGN PATENT DOCUMENTS

| | | | |
|---|---|---|---|
| JP | 61 095157 | A | 5/1986 |
| JP | 61 095159 | A | 5/1986 |
| JP | 61 113953 | A | 5/1986 |
| JP | 9 096077 | A | 4/1997 |
| JP | 11 309093 | A | 11/1999 |
| JP | 2004 008557 | A | 1/2004 |
| JP | 2004 097483 | A | 4/2004 |
| JP | 2004 141635 | A | 5/2004 |
| JP | 2005 052323 | A | 3/2005 |

* cited by examiner

WALL-MOUNTED PATIENT EGRESS AND PATIENT ASSIST BAR

CROSS-REFERENCE TO RELATED APPLICATIONS

The present application claims the benefit, under 35 U.S.C. §119(e), of U.S. Provisional Application No. 61/248,166 which was filed Oct. 2, 2009 and which is hereby incorporated by reference herein.

BACKGROUND

The present disclosure relates to grab bars used by persons to assist standing or walking. More particularly, the present disclosure relates to wall-mounted patient egress and assist bars that are used in healthcare facilities and that are gripped by persons getting into or out of bed and/or moving from one part of a room to another.

Patients in healthcare facilities such as hospitals and nursing homes oftentimes have difficulty getting into and out of their beds. In addition, when some patients that have difficulty standing or walking need to use a bathroom, for example, a caregiver is beckoned by the patient using a nurse call button located on their beds or on a hand held unit that is coupled to a nurse call system. The caregiver then comes to the room and assists the patient from their bed to the bathroom and then, a short time later, from the bathroom back to their beds.

Sometimes a stationary grab bar is attached to the wall adjacent to the patient's bed. However, a spatial gap oftentimes exists between the egress point of the patient's bed and the point at which a patient can reach the stationary wall-mounted grab bar. Accordingly, there is a need for improved grab bar devices used in healthcare facilities to assist patients getting into and out of their beds and, optionally, in assisting patients from moving from one location of a room to another. For example, a grab bar that assists a patient from moving from their beds to a bathroom may reduce the number of nurse calls that caregivers receive, thereby freeing up caregiver time to attend to potentially more urgent healthcare needs of their patients.

SUMMARY

The present invention comprises an apparatus and/or method that has any one or more of the features listed in the appended claims and/or any one or more of the following features, which alone or in any combination may comprise patentable subject matter:

A support apparatus according to this disclosure may comprise a patient assist bar that is coupled to a room wall or to some other structure in a room of a healthcare facility, such as a headwall that is configured to be coupled to the room wall. The patient assist bar may be pivotable about one or more axes such as a first axis that is substantially vertical and parallel to the headwall and a second axis that is substantially horizontal. For example, the patient assist bar may pivot about the second axis downwardly from an upward stored position, in which a long axis of the patient assist bar is vertically oriented and parallel with the wall of the room, to an outward deployed or use position in which the long axis of the patient assist bar extends generally perpendicular to the wall of the room. In the use position, the patient assist bar may be in a generally horizontal orientation. Also, when in the use position and oriented generally horizontally, the patient assist bar may pivot about the generally vertical axis into a number of orientations relative to the wall.

In some embodiments, the patient assist bar may include a base having a first body component that is pivotable about the vertical axis and a second body component coupled to the wall or headwall. The patient assist bar may also include a rail extending from a proximal end to a distal end. The proximal end of the rail may be coupled to the first body component of the base. Additionally, in some embodiments, the first body component of the base may include a slot, and the rail may be received in the slot. A pin may extend along the horizontal axis through the first body component of the base and the proximal end of the rail. The apparatus may include a stop to prevent the patient assist bar from pivoting downwardly beyond the horizontal orientation. A surface of the first body that defines a bottom of the slot may serve as such a stop.

In some embodiments, the headwall may comprise a cabinet having a storage chamber and a door secured to the cabinet. The door may be movable between a closed position in which access to the storage chamber is blocked and an open position in which the storage chamber is accessible. The patient assist bar may be situated in the storage chamber when the rail is in the stored position and the patient assist bar may extend outwardly from the storage chamber when in the deployed or use position.

In some embodiments, the support apparatus may further comprise a locking mechanism configured to fix the patient assist bar at a plurality of predefined positions about the vertical axis. Additionally, in some embodiments, the locking mechanism may comprise a lock member, such as a pin, finger, or latch, coupled to the patient assist bar and a lock receiver, such as a disk with holes or pockets, which is fixed in position relative to the headwall. The holes or pockets in the disk may be located in a circular pattern about the first axis, and the lock member may be receivable in each of the plurality of holes or pockets when the rail is in the deployed position to fix the position of the patient assist bar about the vertical axis in respective ones of the plurality of predefined positions.

In some embodiments, the patient assist bar may include a user input member, such as for example a handle, lever, trigger, or button, that is movable to withdraw the pin from each of the plurality of holes or pockets to unlock the patient assist bar for pivoting movement about the first axis. Thus, a suitable linkage mechanism such as a series of links or cables or combinations of these may be provided to interconnect the input member with the locking member so that movement of the input member is transmitted to the locking member via the linkage mechanism. The linkage mechanism may be located within an interior region of the patient assist bar. Thus, the patient assist bar may be a tubular member in some embodiments.

In some embodiments, the support apparatus may further comprise a support leg having a first end pivotably coupled to the patient assist bar and a second end spaced from the first end. The second end may be situated adjacent the patient assist bar when the patient assist bar is in the stored position, and the second end of the support leg may move away from the patient assist bar into contact with a floor of the patient room as the patient assist bar is moved from the stored position to the deployed position. In some embodiments, the support leg may include a caster at its second end. According to this disclosure, the leg may be sized and configured so that when it contacts the floor, the patient assist bar is supported in the generally horizontal orientation. Thus, in embodiments that include the leg, the stops that prevent the patient assist bar from moving downwardly below its generally horizontal orientation may be omitted, if desired.

In some embodiments, the support apparatus may further comprise a braking device coupled to the caster and a user input member that is coupled to the patient assist bar and movable to control the braking device. In such embodiments, a suitable linkage mechanism, such as that described above, may be provided to interconnect the user input member with the braking device. Portions of the linkage mechanism may reside within interior regions of the patient assist bar and the leg. In some embodiments, the support apparatus may further comprise a sensor that detects pivoting movement of the patient assist bar about one of the first axis and the second axis and an indicator that provides an indication that pivoting movement of the patient assist bar has been detected.

In some instances, a support apparatus according to this disclosure may be used in a patient room having a hospital bed spaced from an entrance to a bathroom associated with the patient room. The support apparatus may comprise a patient assist bar that is coupled to a wall or headwall of the patient room and pivotable about a generally vertical axis. The patient assist bar is sized and arranged to provide support and guidance for a patient moving between the patient bed and the entrance to the bathroom.

In some embodiments, the patient assist bar may include a first rail coupled to the wall and a second rail telescopically coupled to the first rail and extending horizontally therefrom. The second rail may be extendable and retractable relative to the first rail. In some embodiments, the patient assist bar may comprise a pair of first rails that extend horizontally with one of the pair of first rails being located above the other. The second rail may comprise a U-shaped rail having a pair of horizontally oriented portions that are coupled for telescopic movement to the pair of first rails. In another embodiment, a leg may extend downwardly from the second rail and may have a caster at its lower end. In some embodiments, the patient assist bar does not pivot about a horizontal axis but only pivots about a generally vertical axis.

According to another embodiment, the support apparatus may comprise a patient assist bar and a four-bar linkage having a pair of links coupled at a first end to the patient assist bar for pivoting movement about a first pair of generally vertical axes and coupled at a second end to a wall of the patient room or to some other structure, such as a headwall, for pivoting movement about a second pair of generally vertical axes. The four-bar linkage may be movable between a first position in which a first end of the patient assist bar is located adjacent a patient sitting on an edge of a hospital bed and a second position in which a second end of the patient assist bar is situated adjacent an entrance to the bathroom or adjacent to some other room location.

In some embodiments, the pair of links of the four-bar linkage may be of unequal length. Additionally, in some embodiments, the pair of links may support the patient assist bar in an orientation that is neither parallel with nor perpendicular to the wall of the patient room when the four-bar linkage is in the first position. The pair of links may support the patient assist bar in an orientation parallel with the wall of the patient room when the four-bar linkage is in the second position.

Additional features will become apparent to those skilled in the art upon consideration of the following detailed description of illustrative embodiments exemplifying the best mode as presently perceived.

BRIEF DESCRIPTION OF THE DRAWINGS

The detailed description particularly refers to the accompanying figures in which.

DETAILED DESCRIPTION

Figure 1:
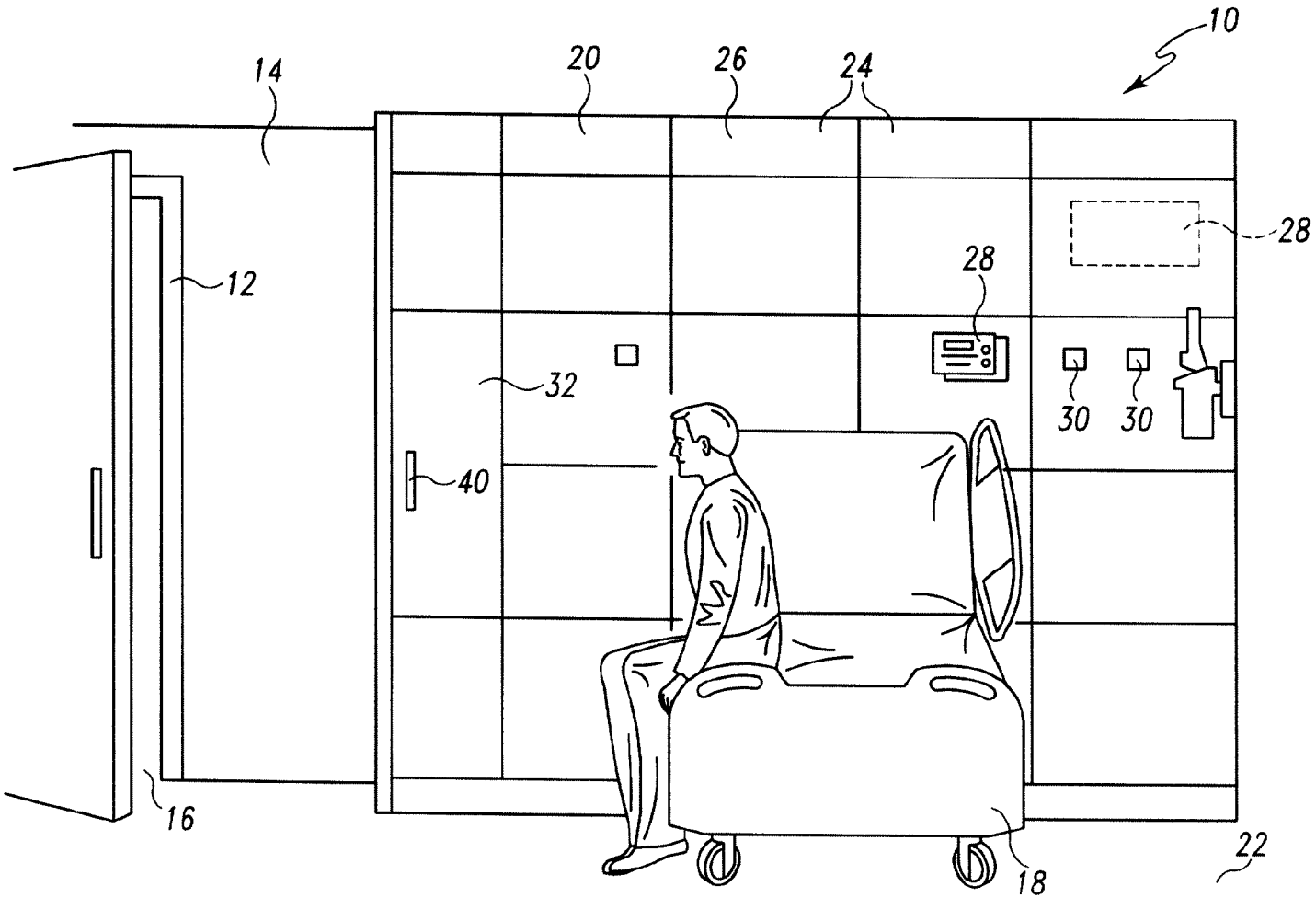
FIG. 1 is a perspective view of a patient room in a hospital.

Referring to FIG. 1, a patient room 10 of a hospital or other medical care facility, such as a nursing home, is shown. The patient room 10 includes a doorway 12 positioned in a wall 14. The doorway 12 leads to a bathroom 16 positioned adjacent to the patient room 10. A headwall 20 is shown mounted to the wall 14, but it should be appreciated that in other embodiments the headwall 20 may be mounted to any of the other walls of the room 10. Headwalls are sometimes referred to as headwall units, but are simply referred to as headwalls herein. A patient bed 18 is positioned adjacent to the headwall 20 on a floor 22, and a patient is shown seated on the mattress of the bed 18.

The headwall 20 includes a plurality of panels 24 that define a front surface 26 and conceal gas pressure lines, vacuum hoses, electrical wiring, or other support for utilities positioned behind the headwall 20. A plurality of nurse-call units 28, a plurality of outlets 30, and other equipment are shown mounted to the headwall 20 in the illustrative example, but these are simply optional components and may not be present in other embodiments. Furthermore, other types of equipment may be mounted to, or included in, headwall 20 as is known in the art. As shown in FIGS. 1-4, the headwall 20 also includes a cabinet 32. The cabinet 32 defines a storage chamber 34 and includes an opening 36 formed on the front side thereof. The opening 36 permits the patient, caregiver, or other individuals to access the storage chamber 34.

A door 38 is hinged to one side of the cabinet 32 such that it moves about a generally vertical axis. In other embodiments, headwall 20 may have doors that slide vertically or horizontally between open and closed positions in lieu of the illustrative hinged door 38. The storage chamber 34 is inaccessible when the door 38 is in a closed position (see FIG. 1) and is accessible when the door 38 is in an open position (see FIG. 2). The door 38 includes a handle 40 that may be used to open and close the door 38. As shown in FIG. 3, the door 38 includes a single door 42 that is secured to the cabinet 32 via a pair of hinges 44. It should be appreciated that in other embodiments the door 38 may include multiple doors. In the single or multiple door embodiments, the door 38 may rotate about a generally vertical axis, as shown in FIGS. 1-4, or a generally horizontal axis where the door 38 swings upward or downward to permit access to the storage chamber 34.

Figure 2:
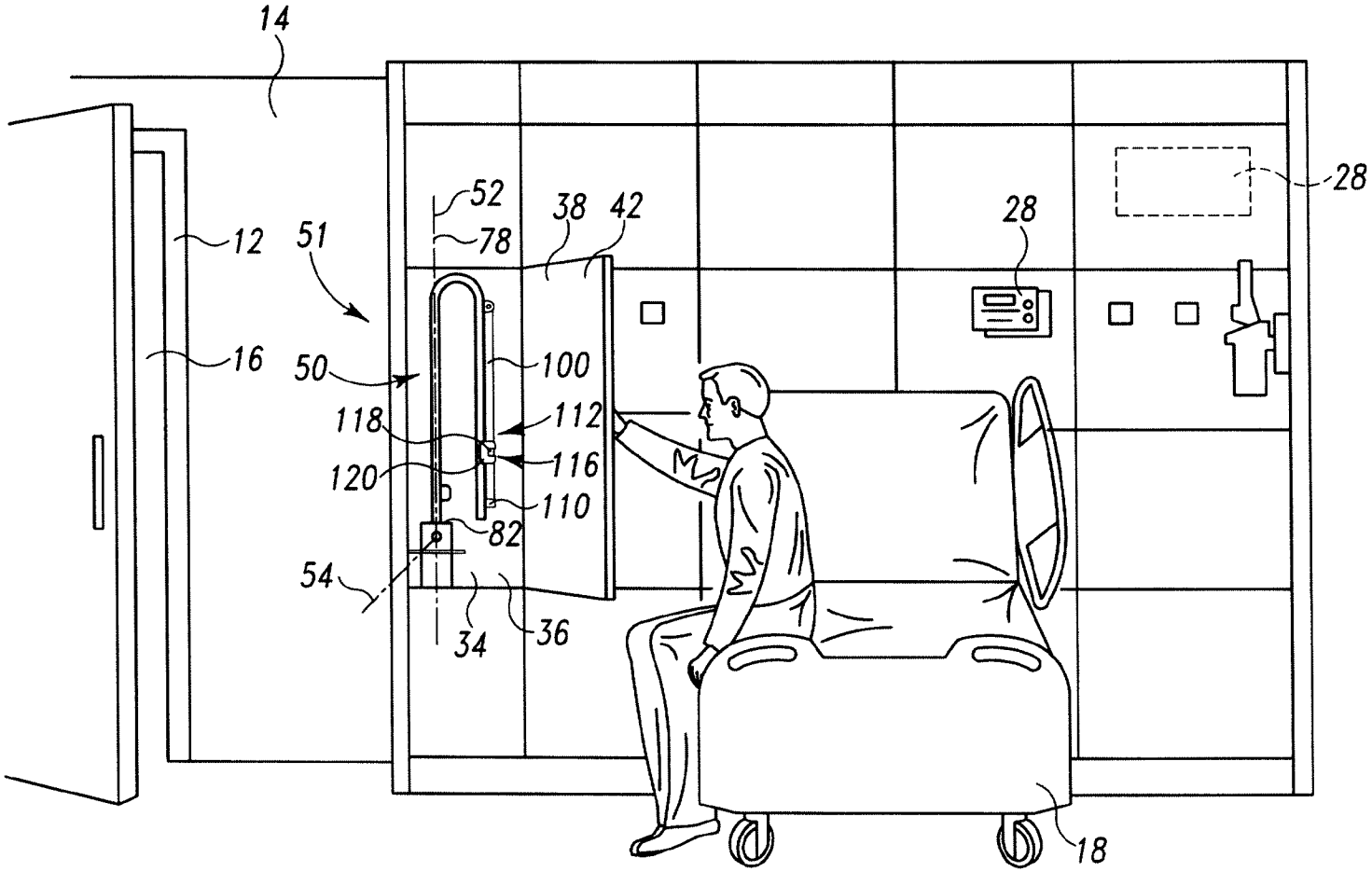
FIG. 2 is a view similar to FIG. 1 showing a patient assist bar.
Figure 3:
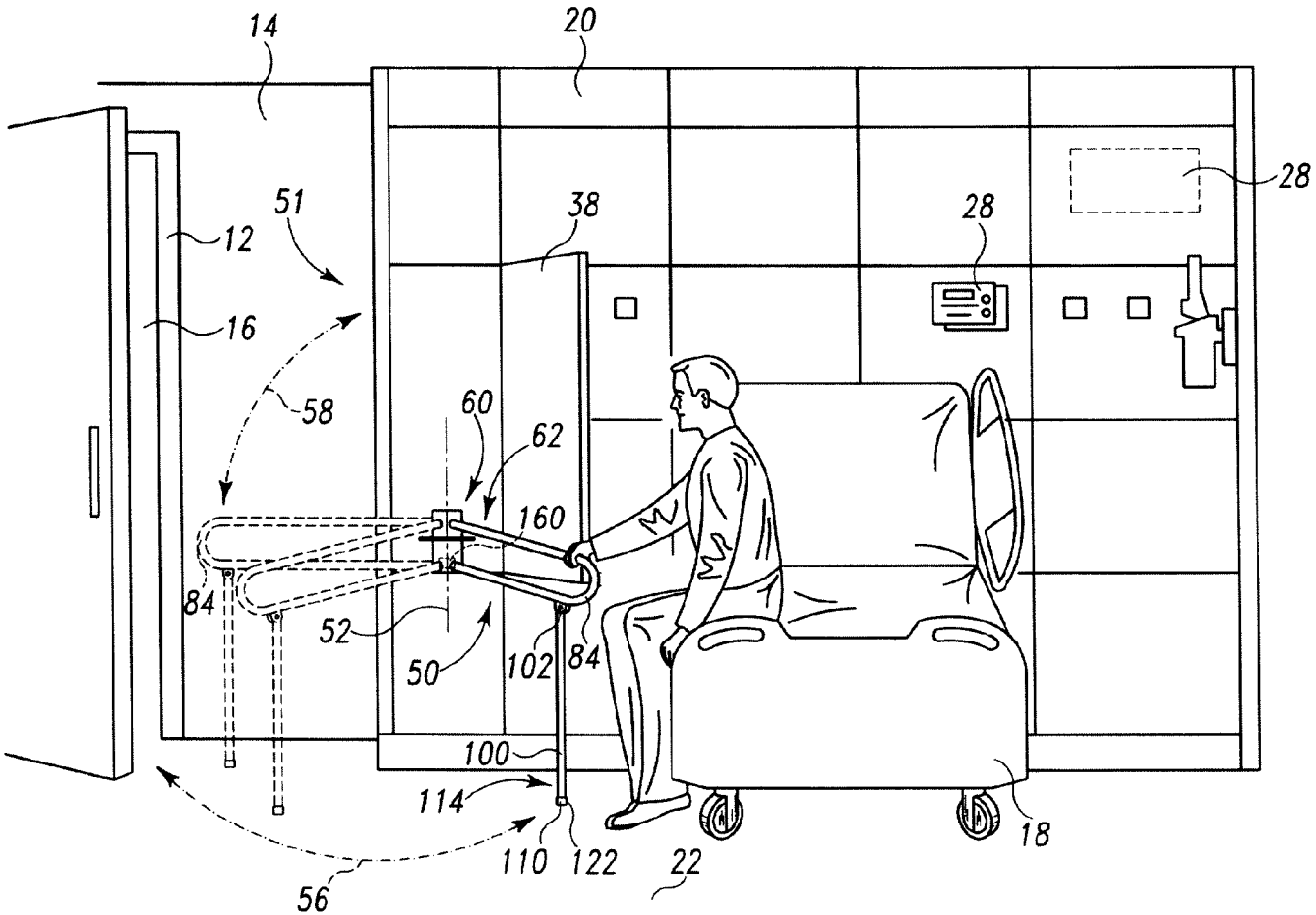
FIG. 3 is a view similar to FIGS. 1 and 2, but showing the patient assist bar deployed in various positions.
Figure 4:
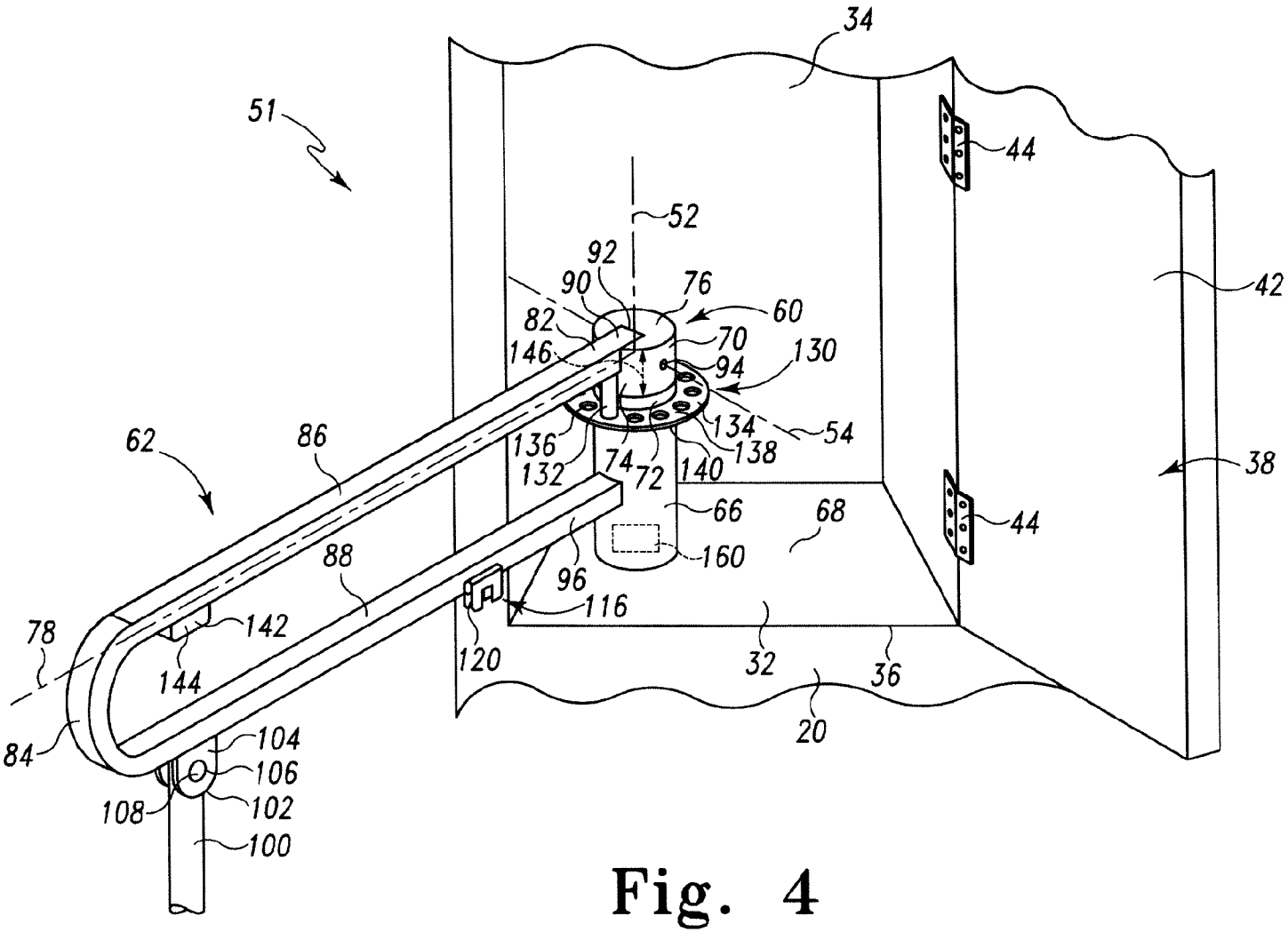
FIG. 4 is a fragmentary perspective view of the patient room of FIGS. 1-3 showing the patient assist bar.

Referring now to FIGS. 2-4, a patient assist bar 50 is shown, which together with the headwall 20 comprises a support apparatus 51. As described in greater detail below and as indicated by a phantom double headed arrow 56 in FIG. 3, the patient assist bar 50 is pivotable about an axis 52 that extends in a generally vertical direction. As indicated by a phantom double headed arrow 58 in FIG. 3, the patient assist bar 50 is also pivotable about a second axis 54 (see FIG. 2) extending horizontally and perpendicularly to the axis 52. In other embodiments, axes 52, 54 do not intersect such that axis 54 may be offset from axis 52. In the illustrative example, the patient assist bar 50 pivots about the axis 54 between an upward, stored position and an outward, deployed or use position as indicated by an arrow 58. When the patient assist bar 50 is in the stored position and door 38 is closed, the door 38 conceals the patient assist bar 50 within the storage chamber 34, as shown in FIG. 2. When in the deployed position, the patient assist bar 50 extends outwardly from the storage chamber 34, as shown in FIGS. 3 and 4, at approximately waist-height. The patient assist bar 50 may be used to provide a stable support and guidance for an ambulatory patient moving about the room 10 within the range of movement of assist bar 50.

The patient assist bar 50 includes a cylindrical base 60 having a rail 62 extending therefrom. All of the components of the patient assist bar 50, including the base 60 and the rail 62, are made from stainless steel in some embodiments. It should be appreciated that in other embodiments the components of patient assist bar 50 may be made from aluminum, titanium, polymer, or other materials having suitable strength and durability characteristics.

The base 60 includes a lower body component 66 that is secured to a bottom surface 68 of the storage chamber 34 and an upper body component 70 that is positioned above the lower body component 66 and coupled thereto. The lower body component 66 extends upwardly from the bottom surface 68 to an end 72. The upper body component 70 includes a bottom end 74 that is situated above the upper end 72 of the lower body component 66. In some embodiments, a bearing (not shown) is provided between body components 66, 70 to facilitate rotation of the upper body component 70 relative to the lower body component 70. The upper body component 70 is further pivotable about the axis 52, which extends through an upper surface 76 of the upper body component 70 positioned opposite the bottom end 74. In the embodiment shown in FIGS. 1-4, the lower body component 66 is fixed relative to the axis 52; however, it should be appreciated that in other embodiments both the lower body component 66 and the upper body component 70 may both pivot about the axis 52.

The rail 62 extends along a long axis 78 from a proximal end 82 to a distal end 84 and includes a first arm 86 spaced apart from a second arm 88. A proximal end 90 of the first arm 86 is received in a slot 92 formed in the upper surface 76 of the upper body component 70. As best shown in FIG. 4, the proximal end 90 of the first arm 86 is coupled to the upper body component 70 via a pin 94 extending along the axis 54. The rail 62 is operable to rotate about the axis 54 to place the patient assist bar 50 in the stored position or the deployed position. When the patient assist bar 50 is in the stored position, the distal end 84 of the rail 62 is positioned above the proximal end 82 and the axis 52 extends through the proximal end 82 and the distal end 84, as shown in FIG. 2. Additionally, the long axis 78 of the patient assist bar 50 is oriented substantially vertical and parallel to the wall 14 of the room 10. When patient assist bar 50 is in the deployed position, the rail 62 extends perpendicularly to the axis 52 and a proximal end 96 of the second arm 88 contacts the lower body component 66 of the base 60. In that position, the long axis 78 is oriented substantially horizontal and perpendicular to the wall 14. A bottom (not shown) of the slot 92 acts as a stop to prevent the patient assist bar 50 from pivoting downwardly beyond that horizontal orientation.

In the deployed position, the rail 62 is operable to pivot with the upper body component 70 such that the distal end 84 of the rail 62 is placed in a plurality of positions about the axis 52. The proximal end 96 of the second arm 88 slides along the fixed lower body component 66 as the rail 62 is rotated about the axis 52. As shown in FIG. 3, the rail 62 is sized such that the distal end 84 is placed within reach of the patient when the patient assist bar 50 is located at one of the positions. In another embodiment, the rail 62 may be a telescopic rail having a length that may be increased or decreased according to the positioning of the bed 18 in the room 10. Additionally, in another embodiment, the rail 62 may be locked in a single position about the axis 52 when the patient assist bar 50 is in the deployed position.

The distal end 84 of the rail 62 is U-shaped to present additional surface area for the patient to grasp by hand. It should be appreciated that in other embodiments the distal end 84 may be formed as a contoured grip or handle and may be coated with rubber or other resistant material that may assist the patient in maintaining a hand grasp on the rail 62. While maintaining a grasp on the rail 62, the patient may then use the patient assist bar 50 for support and guidance in moving about the room 10. For example, the patient may pivot the rail 62 about the axis 52 to move the distal end 84 from a position near the bed 18 to a position proximate to the doorway 12 and the bathroom 16.

The patient assist bar 50 includes a support leg 100 having an end 102 pivotably coupled to the second arm 88 of the rail 62 at a joint 104. The joint 104 has an aperture 106 formed therein sized to receive a cylindrical pin 108. The pin 108 extends through the aperture 106 and the end 102 to thereby secure the support leg 100 to the second arm 88.

The support leg 100 extends from the end 102 to a foot end 110 and has a stowed position 112 and a use position 114. When the support leg 100 is in the stowed position 112, the foot end 110 is situated adjacent to the second arm 88, as shown in FIG. 2. When the support leg 100 is in the use position 114, the foot end 110 is moved away from the second arm 88 and is placed into contact with the floor 22 when the patient assist bar 50 is in the deployed position, as shown in FIG. 3. The support leg 100 is sized and configured so that when it contacts the floor 22, the patient assist bar 50 is supported in the generally horizontal orientation. A locking mechanism (not shown) fixes the support leg 100 in the use position 114.

The patient assist bar 50 includes a latching mechanism 116 that secures the support leg 100 to the second arm 88. The latching mechanism 116 includes a latch 118 that is received in a catch 120 when the support leg 100 is in the stowed position 112. When the latch 118 is released from a catch 120, the foot end 110 of the support leg 100 is permitted to move away from the second arm 88. In other embodiments, the latching mechanism 116 may be a coiled spring that resists the movement of the support leg 100 away from the second arm 88. In such embodiments, the coiled spring is sized such that the mass of the support leg 100 overcomes the resistance of the spring and moves away from second arm 88 as the patient assist bar 50 moves from the stored position to the deployed position. It should be appreciated that in other embodiments the patient assist bar 50 may include other devices or mechanisms that secure and/or release the support leg 100 from the second arm 88.

The foot end 110 has a rubber boot 122 secured thereto. As shown in FIG. 3, the rubber boot 122 may be placed in contact with the floor 22. The rubber boot 122 increases the amount of friction between the support leg 100 and the floor 22 to prevent the support leg 100 from slipping on the floor 22. In other embodiments, the support leg 100 may be positioned such that the foot end 110 does not contact the floor 22 until a downward force is applied to the rail 62. In other embodiments, a caster wheel or caster device may be secured to the foot end 110 of the support leg 100. The caster wheel may roll along the floor 22 as the rail 62 pivots about the axis 52. In addition, the caster wheel may include a braking mechanism that locks the caster wheel such that the wheel resists the movement of the rail 62 about the axis 52. One possible caster wheel and braking mechanism combination is described below in reference to the embodiment shown in FIG. 6.

The patient assist bar 50 includes a locking mechanism 130 operable to fix the rail 62 at any of the plurality of positions about the axis 52. As shown in FIG. 4, the locking mechanism 130 includes a locking member 132 coupled to the proximal end 90 of the first arm 86 and a lock receiver 134 secured to the end 72 of the lower body component 70. The locking member 132 is embodied as a movable pin, and the lock receiver 134 is embodied as a disk. The lock receiver 134 has a plurality of holes or pockets 136 arranged in a circular pattern about the axis 52. Each of the holes 136 extends from an upper surface 138 to a lower surface 140, and each hole 136 is sized to receive the locking member 132 when the patient assist bar 50 is in the deployed position. By placing the locking member 132 in one of the holes 136, the distal end 84 of the rail 62 is fixed or locked in the corresponding position about the axis 52.

The rail 62 includes an input member 142 that is used to withdraw the locking member 132 from one of the holes 136 and unlock the patient assist bar 50 for pivoting movement about the axis 52. As shown in FIG. 4, the input member 142 is a depressible button 144 that is coupled to the locking member 132 via a linkage mechanism (not shown) located within the rail 62. The linkage mechanism may be a series of links or cables or any combination thereof that interconnect the button 144 to the locking member 132 so that movement of the button 144 is transmitted to the locking member 132. Pressing the button 144 causes the linkage mechanism to pull the locking member 132 upward in the direction indicated by an arrow 146. When the locking member 132 is clear of the hole 136, the rail 62 may be rotated about the axis 52 to another of the plurality of positions. Releasing the button 144 at the next desired position about the axis 52 causes the locking member 132 to move into the corresponding one of the holes 136, thereby locking the patient assist bar 50 at that position.

As mentioned above, in some embodiments, the locking mechanism 130 may be a caster wheel having caster braking mechanism secured to the foot end 110. By applying the caster braking mechanism, the rail 62 may be prevented from moving about the axis 52. In some embodiments, the locking mechanism 130 may be an electric motor. In those embodiments, the patient or other user may press a button to cause the motor to move the rail 62 to different positions about the axis 52. Once at the next desired position, the patient may release the button to shut down the motor and lock the rail 62 into that position. In some embodiments, the locking mechanism 130 may be a MechLok® device, commercially available from Porter Group, LLC of Novi, Mich. It should be appreciated that in other embodiments the locking mechanism 130 may be any other mechanical or electrical device operable to lock the rail 62 in one of the plurality of positions about axis 52.

The patient assist bar 50 includes a sensor 160 that indicates the position of the patient assist bar 50. The sensor 160 is operable to generate an electronic signal indicative of the position of the patient assist bar 50 and relay that signal to one of the nurse-call units 28 or other patient monitoring system in the medical facility. One type of patient monitoring system is disclosed in U.S. Pat. No. 7,319,386, which is incorporated herein by reference. For example, if the sensor 160 detects that the patient assist bar 50 has been moved from the stored position to the deployed position or the stored position, the sensor 160 will generate a signal that is transmitted via hardwire or wirelessly to one of the nurse-call units 28. Each of the nurse-call units 28 is operable to relay that signal to the nurse station, pager, or other device to alert the hospital staff that the patient may be preparing to move about the room 10. The signal may also be transmitted to an automated environmental control, which may use the signal to, for example, automatically increase the lighting in the room 10. Similarly, if the sensor 160 detects that the patient assist bar 50 has been pivoted about the axis 52, the sensor 160 may generate a second, different signal to alert the hospital staff to movement in the room 10.

Figure 5:
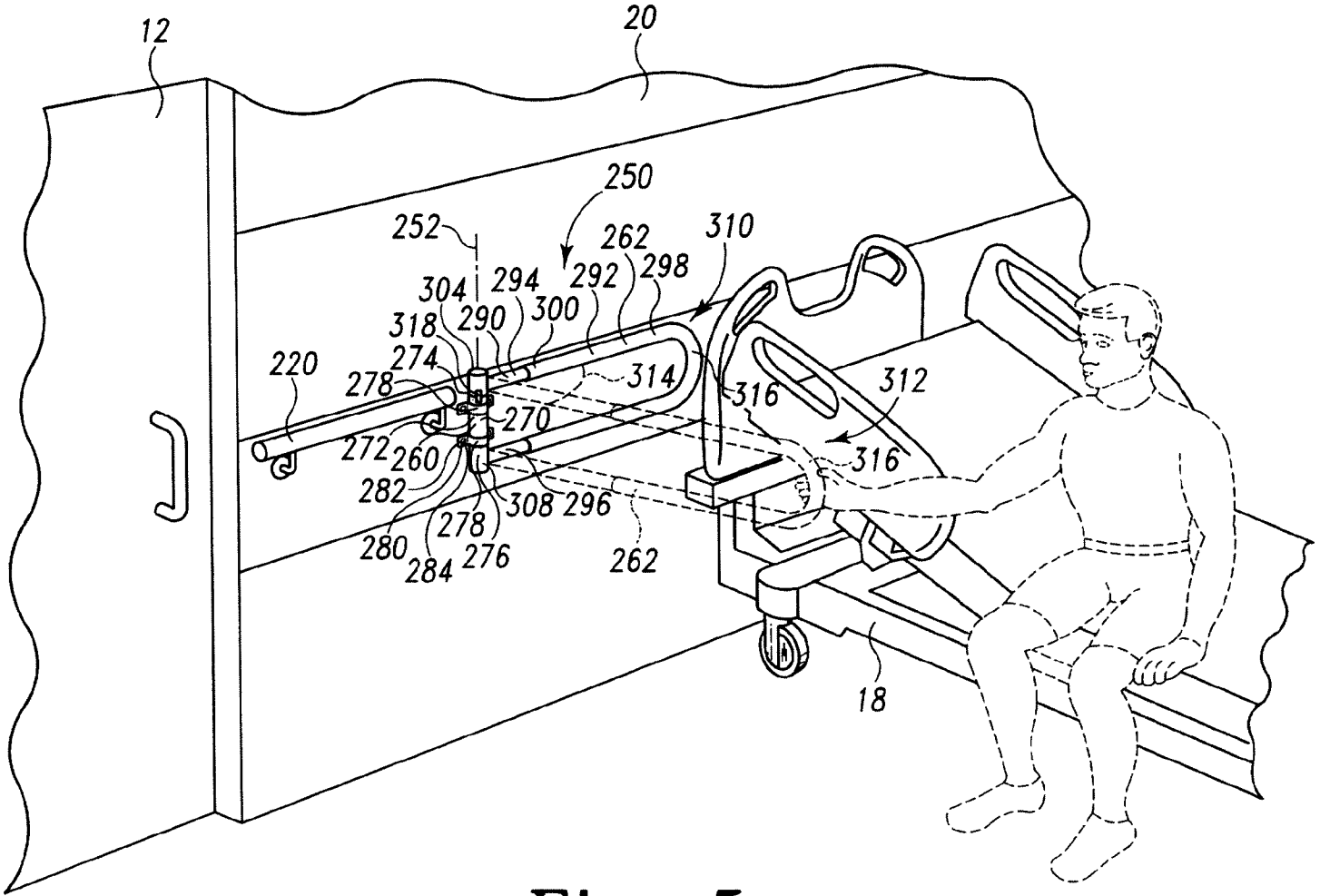
FIG. 5 is a perspective view of a patient room showing another embodiment of the patient assist bar.
Figure 6:
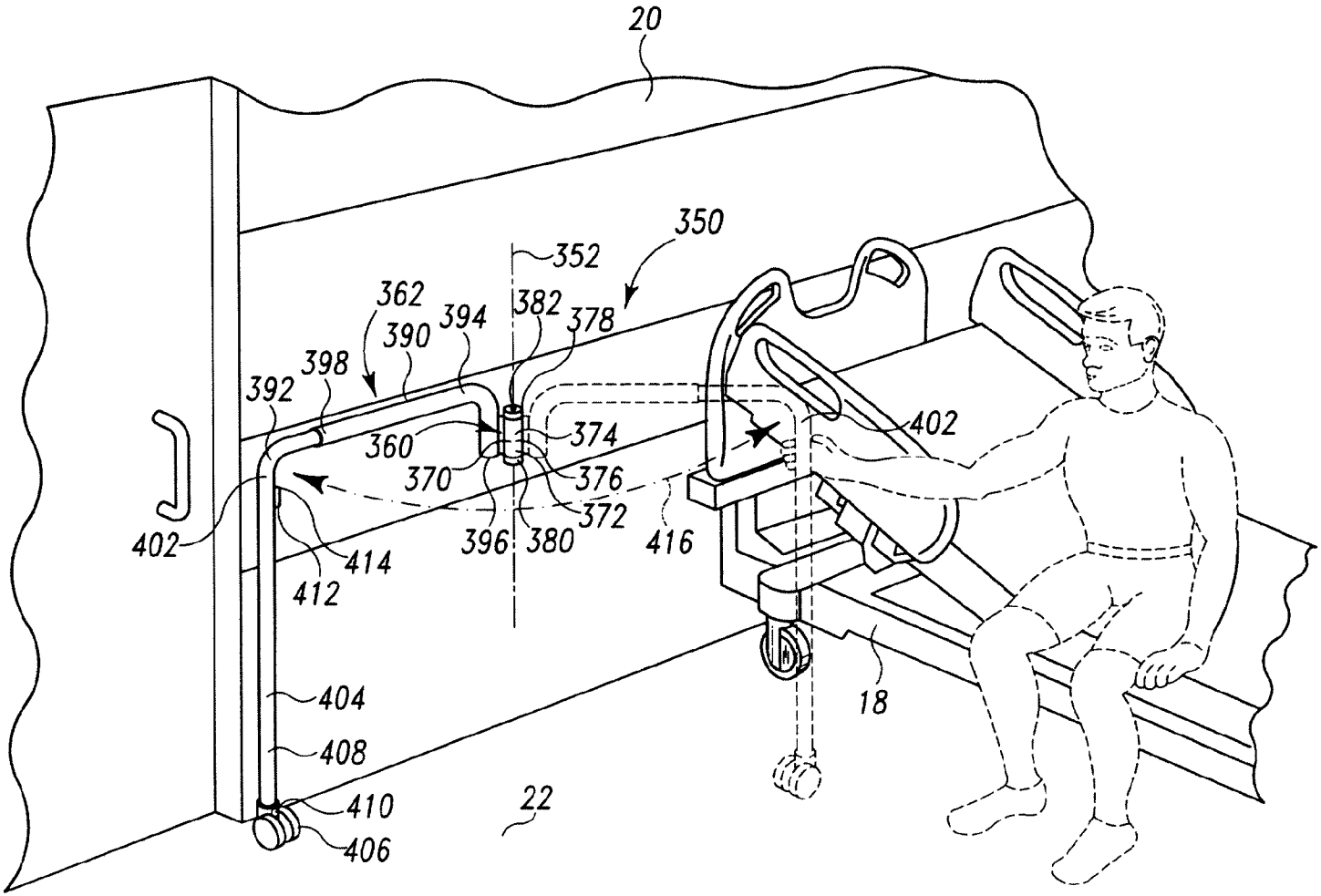
FIG. 6 is a perspective view of a patient room showing another embodiment of the patient assist bar.
Figure 7:
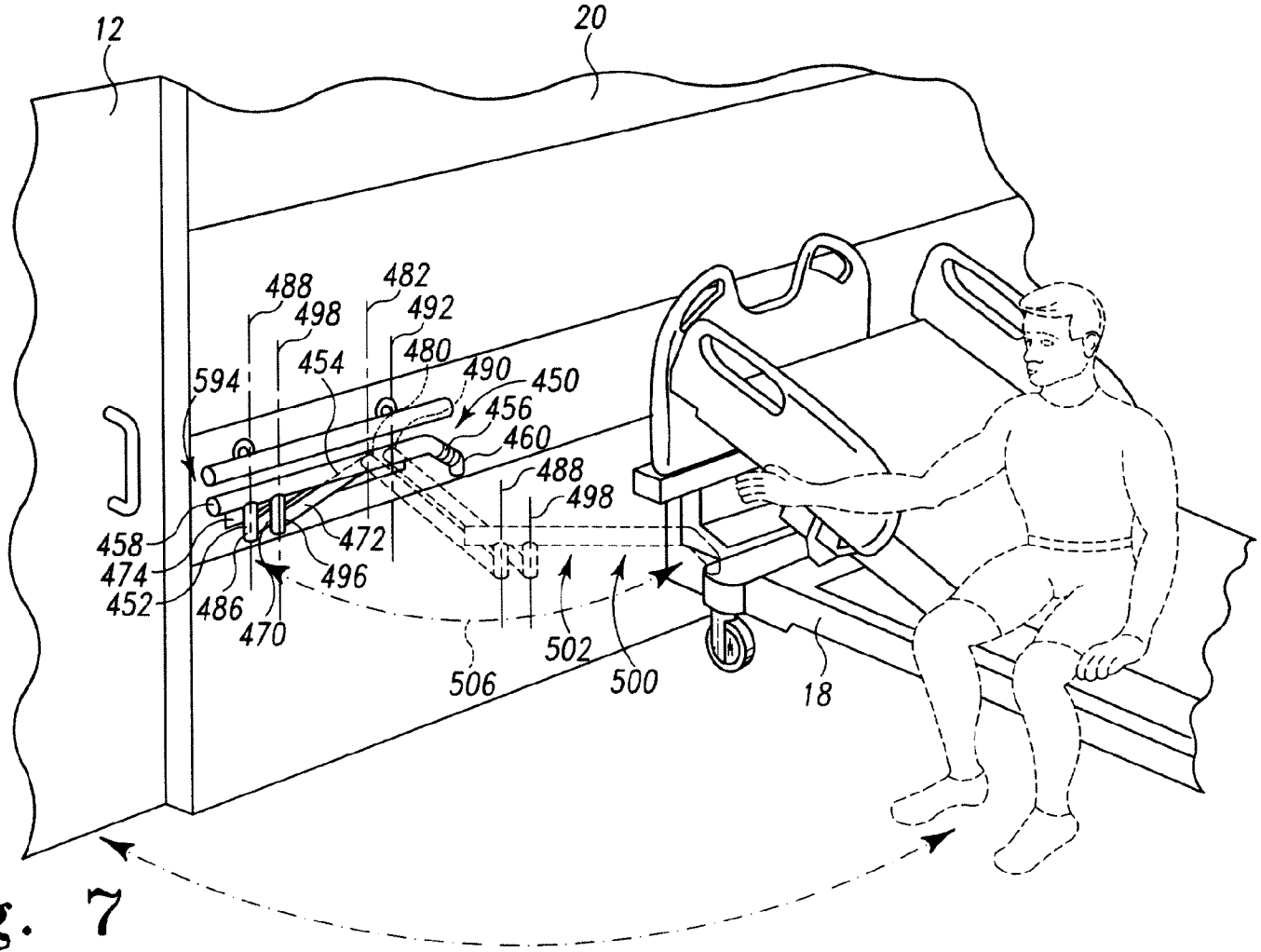
FIG. 7 is a perspective view of a patient room showing another embodiment of the patient assist bar.

Referring now to FIGS. 5-7, other embodiments of a patient assist bar are illustrated. Some features of the embodiments illustrated in FIGS. 5-7 are substantially similar to those discussed above in reference to the embodiment of FIGS. 1-4. Such features are designated in FIGS. 5-7 with the same reference numbers as those used in FIGS. 1-4.

Referring to FIG. 5, in another embodiment, a patient assist bar 250 is shown secured to the headwall 20. An axis 252 extends in a generally vertical direction in an orientation parallel to the headwall 20. As described in greater detail below, the patient assist bar 50 is operable to pivot about the axis 252 between two positions. Like the embodiment of FIGS. 1-4, the patient assist bar 250 provides a stable support for an ambulatory patient in moving about the room 10. It should be appreciated that in other embodiments the patient assist bar 250 might be configured to move to any of a number of positions about the axis 252.

The patient assist bar 250 includes a cylindrical base 260 having a telescopic rail 262 extending horizontally therefrom. The base 260 includes a body component 270 having an outer surface 272 extending from an upper end 274 to lower end 276. A mounting bracket 278 is positioned near each of the ends 274, 276, and each bracket 278 is fixed to the outer surface 272 via an arc-weld. Each mounting bracket 278 has a pair of mounting feet 280 that contact the headwall 20 on each side of the body component 270. An aperture 282 extends through each of the mounting feet 280 and receives a bolt 284 to secure the base 260 to the headwall 20.

The telescopic rail 262 includes a pair of rail sections 290, 292 that are movable relative to one another. The rail section 290 includes an upper arm 294 and a lower arm 296. The rail section 292 includes a U-shaped member 298 having an upper end 300 and a lower end 302. An end of the upper arm 294 of rail section 290 is received in, and telescopes with, the upper end 300 of the U-shaped member 298 while an end of the lower arm 296 is received in, and telescopes with, the lower end 302 of the U-shaped member 298.

The rail section 290 is pivotably secured to the body component 270 such that the telescopic rail 262 is operable to pivot about the axis 252. A proximal end 304 of the upper arm 294 is pivotably secured to the end 274 of the body component 270 via a pin (not shown) extending along the axis 252. Similarly, the lower arm 296 includes a proximal end 308 that is pivotably secured to the end 276 of the body component 270 via a pin (not shown) extending along the axis 252. In this way, the telescopic rail 262 is pivotably between a position 310, where the telescopic rail 262 is positioned in an orientation parallel with the headwall 20, and a position 312, where an angle 314 is defined between the headwall 20 and the telescopic rail 262.

As shown in FIG. 5, the rail section 292 telescopes relative to the rail section 290 to place a distal end 316 of the telescopic rail 262 within reach of the patient when telescopic rail 262 is at the position 312. A latching mechanism 318 positioned at the proximal end 304 of upper arm 294 engages with the body component 270 to fix or lock patient assist bar 250 at the position 312. The telescopic rail 262 includes a locking mechanism (not shown) that fixes the position of rail section 292 relative to rail section 290 and prevents rail section 292 from moving.

The generally u-shape of the distal end 316 of the telescopic rail 262 presents additional surface area for the patient to grasp by hand. It should be appreciated that in other embodiments the distal end 316 may be formed as a contoured grip or handle and may be coated with rubber or other resistant material that may assist the patient in maintaining a hand grasp on the telescopic rail 262.

The patient may grasp the distal end 316 of the telescopic rail 262 to move from a seated position to a standing position. Passing along the length of telescopic rail 262 when located at the position 312, the patient is placed with reach of a grab bar 220 secured to the headwall 20. The patient may then use the grab bar 220 to move to bathroom 16. In this way, the patient assist bar 250 provides a stable support and assistance to the patient in moving from the bed 18 to the doorway 12 and beyond to bathroom 16.

Referring to FIG. 6, in another embodiment, a patient assist bar 350 is shown secured to the headwall 20. An axis 352 extending in a generally vertical direction in an orientation parallel to the headwall 20 passes through the patient assist bar 350. As described in greater detail below, the patient assist bar 350 is operable to pivot about the axis 352. Like the other embodiments described herein, the patient assist bar 350 provides a stable support and guidance for an ambulatory patient in moving about the room 10.

The patient assist bar 350 includes a cylindrical base 360 having a telescopic rail 362 extending horizontally therefrom. The base 360 includes a body component 370 having an outer surface 372 extending from an end 374 to an end 376. A pair of mounting brackets 378, 380 is secured to the headwall 20 and is positioned at each of the ends 374, 376. A pin 382 secured at an end of the bracket 378 extends along the axis 352 downwardly into a hollow passageway (not shown) formed in the body component 370. The pin 382 is secured at the opposite end (not shown) to the bracket 380. The body component 370 is pivotable about the pin 382 and axis 352.

The telescopic rail 362 includes a pair of rail sections 390, 392 that are movable relative to one another. The rail section 390 includes an arm 394 secured at an end 396 to the body component 370 such that the telescopic rail 362 pivots with the body component 370 about the axis 352. An end 398 of the arm 394 positioned opposite the end 396 receives a first end of the rail section 392. The movement of the telescopic rail 362 about axis 352 and the telescopic motion of the rail section 392 are operable to place a second end 402 of the rail section 392 within reach of the patient. A support leg 404 extends downwardly from the end 402 and presents additional surface area for the patient to grasp by hand. It should be appreciated that in other embodiments the end 402 may be formed as a contoured grip or handle and may be coated with rubber or other resistant material that may assist the patient in maintaining a hand grasp on the telescopic rail 362.

The support leg 404 has a caster device or caster wheel 406 secured at a lower end 408 adjacent to the floor 22. The caster wheel 406 is operable to roll along the floor 22 as the telescopic rail 362 pivots about the axis 352. A braking device 410 coupled to the caster wheel 406 prevents the caster wheel 406 from rolling. The rail section 392 includes a user input member 412 that is used release the braking device 410.

As shown in FIG. 6, the input member 412 is a depressible button 414 that is coupled to the braking device 410 via a linkage mechanism (not shown) located within support leg 404. The linkage mechanism may be a series of links or cables or any combination thereof that interconnect the button 414 to the braking device 410 so that movement of the button 414 is transmitted to the braking device 410. Pressing the button 414 causes the linkage mechanism to disengage the braking device 410 and unlock the caster wheel 406 such that the telescopic rail 362 may be moved along the path indicated by a phantom double headed arrow 416. Releasing the button 414 causes the braking device 410 to engage and lock the caster wheel 406 such that the wheel 406 resists movement of the telescopic rail 362. In that way, the braking device 410 locks the patient assist bar 350 at a fixed position about the axis 352. In another embodiment, the braking device 410 may be engaged using a depressible foot pedal coupled to the caster wheel 406.

Referring to FIG. 7, in another embodiment, a patient assist bar 450 is shown secured to the headwall 20 via a four-bar linkage 452. It should be appreciated that in other embodiments the patient assist bar 450, like the other embodiments discussed herein, may be secured to the wall 14 rather than to the headwall 20. Like the other embodiments described herein, the patient assist bar 450 provides a stable support and guidance for an ambulatory patient in moving about the room 10. The patient assist bar 450 includes a rail 454 extending from a first end 456 to a second end 458. The first end 456 has a grip 460 secured thereto to assist the patient in maintaining a hand grasp on the rail 454. It should be appreciated that in other embodiments the first end 456 may be U-shaped, L-shaped, or other form to present additional surface area for the patient to grasp.

The four-bar linkage 452 has a pair of links 470, 472 received in a slot 474 of the headwall 20. The link 470 has a first end 480 that is pivotably coupled to the headwall 20 within the slot 474 via a rod (not shown) extending along a generally vertically-extending axis 482. The link 470 extends from the first end 480 to a second end 486. The second end 486 is pivotably secured to the patient assist bar 450 via a pin (not shown) extending along a second generally vertically-extending axis 488.

Similarly, the link 472 has a first end 490 that is pivotably coupled to the headwall 20 within the slot 474 via a rod (not shown) extending along a generally vertically-extending axis 492. The link 472 extends from the first end 490 to a second end 496. The length of the link 472 is not equal to the length of the link 470. The second end 496 is pivotably secured to the patient assist bar 450 via a pin (not shown) extending along another generally vertically-extending axis 498.

As shown in FIG. 7, the pair of links 470, 472 pivot about the pair of axes 482, 492 and the pair of axes 488, 498 to move the four-bar linkage 452 to a plurality of positions about the room. In one position of the plurality of positions, the rail 454 is placed in an orientation neither parallel nor perpendicular to the headwall 20 and the wall 14 of the room 10. In that position, the first end 456 of the patient assist bar 450 is located adjacent to a patient sitting on the edge of bed 18. In another position, the rail 454 is placed in an orientation parallel with the wall 14 of the patient room 10 and the second end 458 of the rail 454 is positioned adjacent to the bathroom 16. As indicated by the phantom double headed arrow 506, the patient may also place the patient assist bar 450 and the four-bar linkage 452 in any of the plurality of positions while moving about the room 10.

Although certain illustrative embodiments have been described in detail above, variations and modifications exist within the scope and spirit of this disclosure as described and as defined in the following claims.

The invention claimed is:

1. A support apparatus comprising:

a headwall configured to be coupled to a wall of a room of a healthcare facility, the headwall comprising (i) a plurality of panels configured to conceal utility lines of the healthcare facility between the wall and the headwall, (ii) a cabinet having a storage chamber defined therein, and (iii) a door secured to the cabinet that is moveable between a closed position in which access to the storage chamber is blocked and an open position in which the storage chamber is accessible, the door cooperating with the plurality of panels to define a front surface of the headwall, a patient assist bar including (i) a base having a lower end positioned in the storage chamber and coupled to the headwall and (ii) a rail pivotally coupled to an upper end of the base, wherein the rail of the patient assist bar has a long axis and is (i) pivotable about a first axis that is substantially vertical and parallel to the headwall and (ii) pivotable about a second axis that is substantially horizontal between an upward stored position and an outward deployed position when the door is in the open position, wherein when the rail is in the upward stored position, (i) the long axis of the rail is oriented generally vertical, and (ii) the rail is situated in the storage chamber, and wherein when the patient assist bar is in the outward deployed position, (i) the long axis of the rail is oriented generally horizontally, and (ii) the rail extends outwardly from the storage chamber and is pivotal about the first axis to assist movement of a patient.

2. The support apparatus of claim 1, wherein the base has a first body component that is pivotable about the first axis and a second body component coupled to the headwall, and the rail extends from a proximal end to a distal end, the proximal end of the rail being coupled to the first body component of the base.

3. The support apparatus of claim 2, wherein the first body component of the base includes a slot, the rail is received in the slot, and a pin extends along the second axis through the first body component of the base and the proximal end of the rail.

4. The support apparatus of claim 1, further comprising a locking mechanism configured to fix the patient assist bar at a plurality of predefined positions about the first axis.

5. The support apparatus of claim 4, wherein the locking mechanism comprises a locking member coupled to the patient assist bar and a lock receiver fixed in position relative to the headwall, the lock receiver has a plurality of holes which are located in a circular pattern about the first axis, and the locking member is receivable in each of the plurality of holes when the rail is in the deployed position to fix the position of the patient assist bar about the first axis in respective ones of the plurality of predefined positions.

6. The support apparatus of claim 5, wherein the patient assist bar includes a user input member that is movable to withdraw the locking member from each of the plurality of holes to unlock the patient assist bar for pivoting movement about the first axis.

7. The support apparatus of claim 1, further comprising a support leg having a first end pivotably coupled to the patient assist bar and a second end spaced from the first end, the second end being situated adjacent the patient assist bar when the patient assist bar is in a stored position, and the second end of the support leg being moved away from the patient assist bar into contact with a floor of the patient room when the patient assist bar is in a deployed position.

8. The support apparatus of claim 7, wherein the support leg includes a caster at its second end.

9. The support apparatus of claim 8, further comprising a braking device coupled to the caster and a user input member that is coupled to the patient assist bar and movable to control the braking device.

10. The support apparatus of claim 1, further comprising a sensor that detects pivoting movement of the patient assist bar about one of the first axis and the second axis and an indicator that provides an indication that pivoting movement of the patient assist bar has been detected.

11. A support apparatus for use in a patient room having a hospital bed spaced from an entrance to a bathroom associated with the patient room, the support apparatus comprising:

a cabinet attached to a wall of the patient room, the cabinet having a storage chamber defined therein, a door attached to the cabinet, the door being pivotal between a closed position in which access to the storage chamber is blocked and an open position in which the storage chamber is accessible, and a patient assist bar coupled to the cabinet, the patient assist bar including a base having a lower end positioned in the storage chamber and secured to the cabinet and a rail coupled to an upper end of the base, the rail being pivotable about a generally vertical axis, and the rail being movable about a generally horizontal axis when the door is in the open position between (i) a first position in which the rail is oriented generally vertical and is located in the storage chamber, and (ii) a second position in which the rail is oriented generally horizontal and extends outwardly from the storage chamber, wherein the patient assist bar is pivotal about the generally vertical axis to provide support and guidance for a patient moving between the patient bed and the entrance to the bathroom when the rail is in the second position.

12. The support apparatus of claim 11, wherein the patient assist bar includes a locking mechanism that locks the patient assist bar in at least one fixed position about the generally vertical axis.

13. The support apparatus of claim 11, further comprising a support leg extending downwardly from the patient assist bar into contact with a floor of the patient room when the rail is in the second position.

* * * * *